United States Patent [19]

Feinberg

[11] Patent Number: 4,805,918

[45] Date of Patent: Feb. 21, 1989

[54] FRANGIBLE TARGET GAME

[76] Inventor: Andrea L. Feinberg, 15 Alexander St., Framingham, Mass. 01701

[21] Appl. No.: 95,116

[22] Filed: Sep. 11, 1987

[51] Int. Cl.[4] ..... A63F 9/02; F41J 7/04

[52] U.S. Cl. ..... 273/380; 273/157 R

[58] Field of Search ..... 273/1 GF, 157 R, 380, 273/415

[56] References Cited

U.S. PATENT DOCUMENTS

| | | | |
|---|---|---|---|
| D. 170,645 | 10/1953 | Logue | 273/157 RX |
| 1,230,263 | 6/1917 | Alexander | 273/157 RX |
| 1,282,358 | 10/1918 | Arden | 273/380 |
| 2,723,124 | 11/1955 | Martin | 273/157 RX |
| 3,014,724 | 12/1961 | Cryder et al. | 273/344 |
| 3,092,384 | 6/1963 | Herne | 273/1 G F |
| 4,087,091 | 5/1978 | De Lorge | 273/415 X |

OTHER PUBLICATIONS

Washington Post Magazine, Apr. 20, 1980, p. 55, 273-157 R.

*Primary Examiner*—Anton O. Oechsle

*Attorney, Agent, or Firm*—Irving M. Kriegsman

[57] ABSTRACT

A game for use in alleviating stress includes a stand. The stand, which is in the shape of a rectangular parallelipiped, has a groove, also rectangular in shape, extending longitudinally across its entire length. A plate, made up of transparent plastic, is disposed in said groove. Said plate has a smooth surface upon which figures or letters may be drawn and later erased. Said plate is rectangular in shape and comprises a plurality of separate interlocking pieces. Said game also includes a bean bag for impacting against said plate and for dissociating said plate into said separate interlocking pieces.

2 Claims, 2 Drawing Sheets

FRANGIBLE TARGET GAME

BACKGROUND OF THE INVENTION

The present invention relates generally to games and more particularly to games in which a projectile is thrown at a stationary object.

Stress, which has been shown to be deleterious to the physical and emotional well-being of many individuals, is frequently the result of accumulated frustration brought on by the pressures of the home and/or the office. Fortunately, stress has been shown to be reduced in those individuals who are expressive of their feelings of frustration. Unfortunately, far too many people today lead sedentary lifestyles in which opportunities for emotional expression are far too infrequent for any significant benefit to accrue. As a result, those stressful individuals who cannot or choose not to express their feelings of frustration have no effective means for alleviating stress.

Accordingly, it is abundantly clear that a need exists for a device that can be used in the home or office and that safely and speedily alleviates stress.

It is therefore an object of the present invention to provide a new and improved game.

It is another object of the present invention to provide a new and improved game intended for indoor use.

It is still another object of the present invention to provide a new and improved game intended for indoor use for use in alleviating stress.

It is still yet another object of the present invention to provide a new and improved game which is easy to manufacture, can be mass produced, and is easy to use.

It is still yet a further object of the present invention to provide a new and improved game which is portable and compact enough to be used on a table top.

SUMMARY OF THE INVENTION

A game constructed according to the teachings of the present invention includes a stand, a plate for insertion into the stand which has been cut into a plurality of separate interlocking pieces, and projectile means for impacting against the plate and for dissociating the plate into its separate interlocking pieces.

Various features and objects will appear from the description to follow. In the description, reference is made to the accompanying drawings which form a part thereof, and in which is shown by way of illustrations, specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which like reference numerals or characters represent like parts.

DETAILED DESCRIPTION OF A PREFERRED EMBODIMENT

Figure 1:
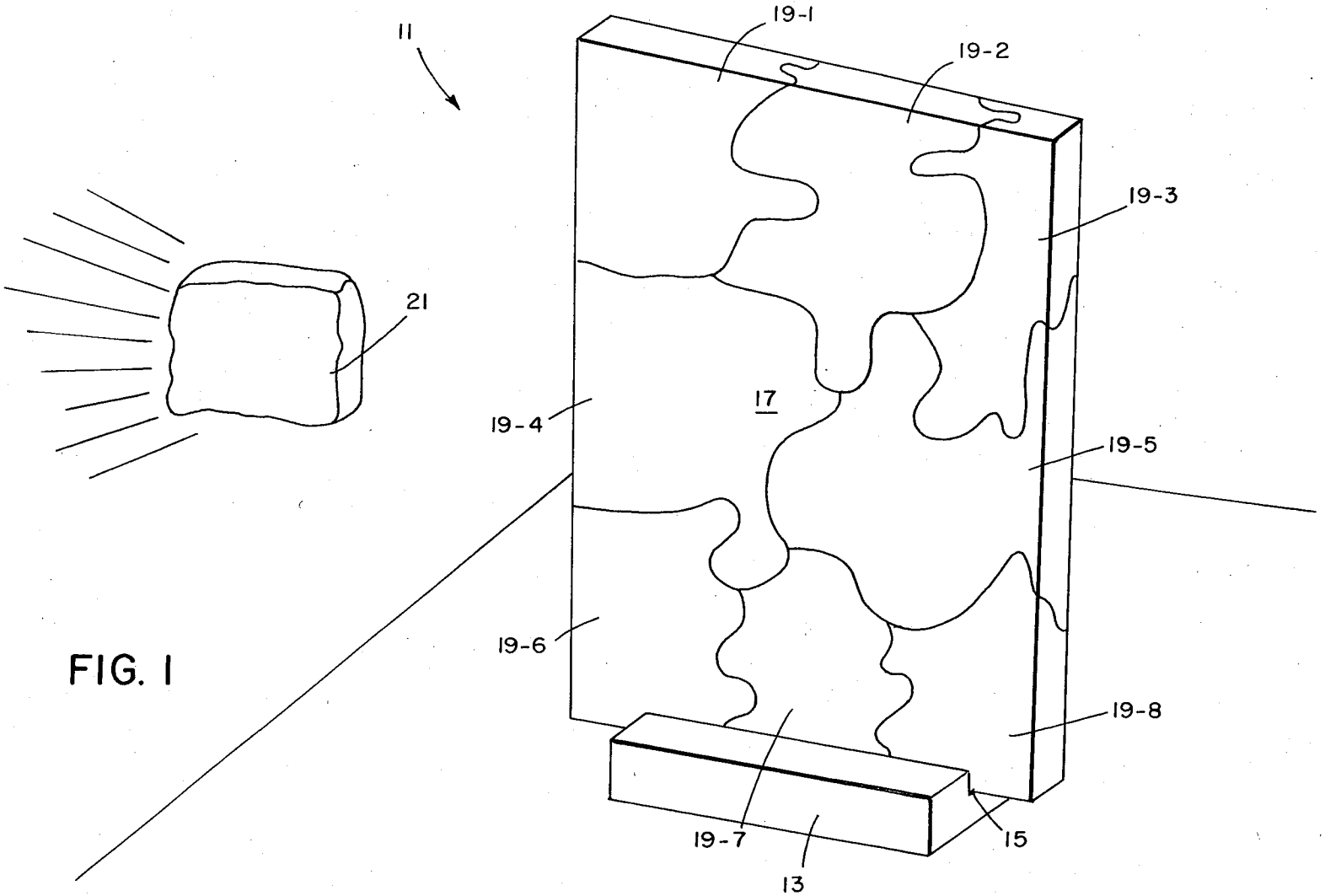
FIG. 1 is a perspective view taken from the front of one embodiment of a game constructed according to the teachings of the present invention as it appears on a table top with the plate assembled and inserted into the stand.
Figure 2:
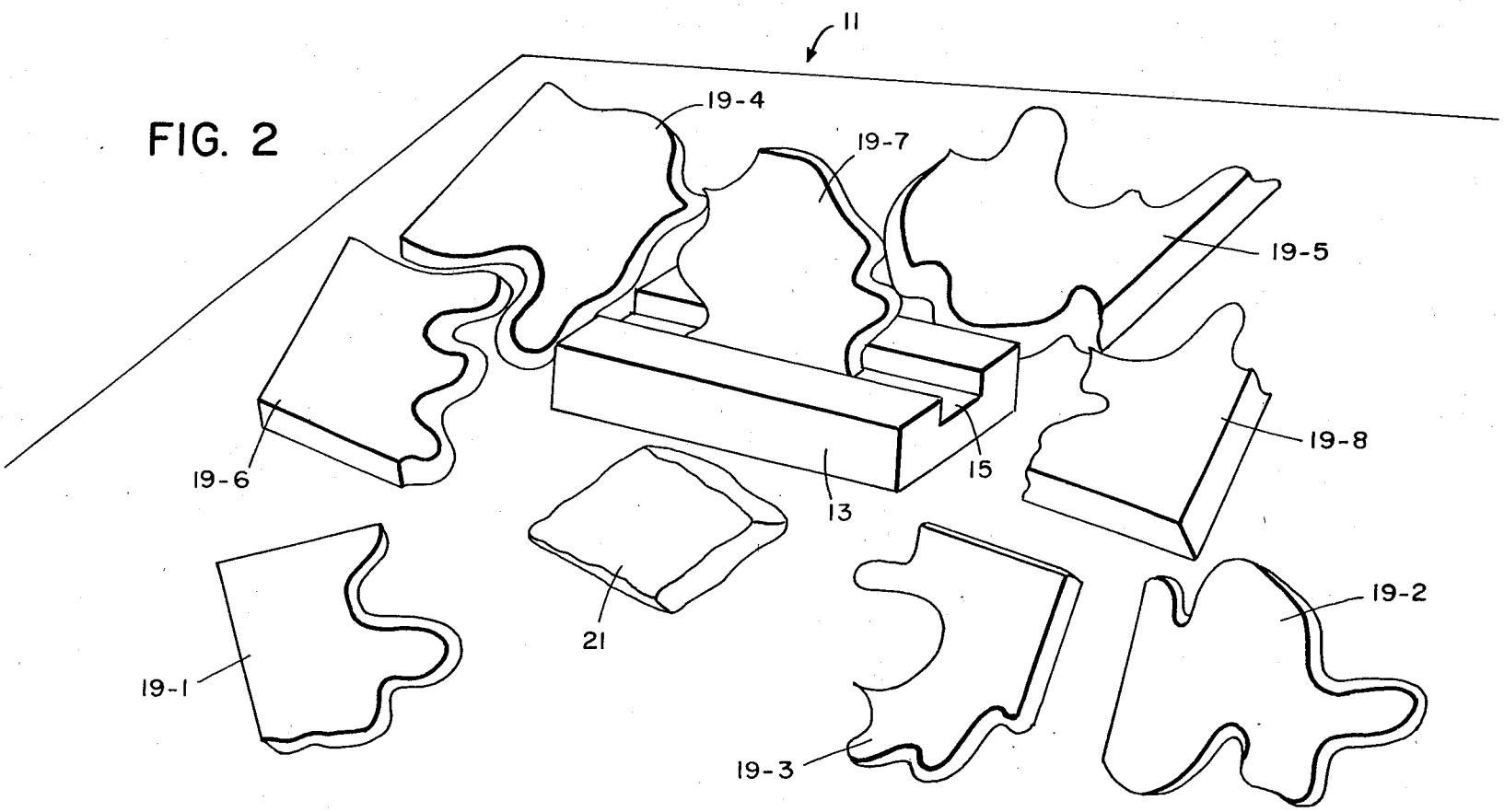
FIG. 2 is a perspective view taken from the front of the game shown in FIG. 1 as it appears on a table top with the plate disassembled and strewn across the table top.

Referring now to the drawings and first to FIG. 1, there is illustrated a game directed to the alleviation and prevention of stress which is intended for indoor use and which is generally designated by reference numeral 11.

Game 11, which is compact enough to be used on a table top or other similar surface, includes a stand 13 made of wood, plastic, or other suitable material. Stand 13, which is in the shape of a rectangular parallelipiped, includes a groove 15, also rectangular in shape, extending longitudinally across its entire length. Stand 13 has dimensions approximating 8 inches in length, 3 inches in width, and 1.5 inches in thickness. Groove 15 has dimensions approximating 8 inches in length, 1 inch in width and 0.75 inch in depth. Stand 13 may include one or more weights (not shown) disposed therein for the purpose of providing increased stability to stand 13 in order to withstand the torque created by the insertion of matter into groove 15.

A plate 17 for insertion into groove 15 is made of a transparent plastic or other similar material and has dimensions approximating 11 inches in length, 8.5 inches in width, and 1 inch in thickness. Plate 17 has a smooth surface upon which figures or letters may be drawn and later erased. Plate 17 is cut into a plurality of separate pieces 19-1 through 19-8 of dissimilar shape and size which fit together like the interlocking pieces of a jigsaw puzzle.

A bean bag 21 for impacting against plate 17 and dissociating plate 17 into plurality of separate pieces 19-1 through 19-8 is a rectangularly shaped object made of fabric or other suitable material and filled with a plurality of beans or the like. Bean bag 21 is small enough to be held in one hand, having dimensions approximating 4 inches in length, 3 inches in width, and 1.5 inches in thickness.

To operate game 11, a user fits together plurality of separate pieces 19-1 through 19-8 to form plate 17. Plate 17 is then inserted into groove 15 of stand 13 so as to be oriented in an upright position. If desired, figures or letters may be drawn onto plate 17. The user then takes bean bag 21, moves a short distance away from plate 17, and throws bean bag 21 at plate 17. When bean bag 21 makes contact with plate 17, plate 17 dissociates into plurality of separate pieces 19-1 through 19-8. Because the dissociation of plate 17 into separate pieces 19-1 through 19-8 simulates the destruction of property, it is believed that the user will experience a release of frustration and, subsequently, a decrease in stress.

For further use, plurality of separate pieces 19-1 through 19-8 are re-assembled to form plate 17, and plate 17 is re-inserted into groove 15 of stand 13.

What is claimed is:

1. A game for use in alleviating stress comprising:

(a) a stand having a groove and being weighted for increased stability, sized to fit on a table top or other similar surface and (b) a plate disposed in said groove, said plate comprising a plurality of separate interlocking pieces of dissimilar size and shape and made of transparent plastic, said plate having a smooth surface upon which figures of letters may be drawn and later erased, and (c) a bean bag for impacting against said plate and for dissociating said plate into said plurality of separate interlocking pieces.

2. The invention of claim 1 wherein said stand is in the shape of a rectangular parallelipiped, is made of wood and has dimensions approximating 8 inches in length, 3 inches in width, and 1.5 inches in thickness, said groove extends longitudinally across the entire length of said stand and is rectangularly shaped and has dimensions approximating 8 inches in length, 1 inch in width, and 0.75 inch in depth, said plate has dimensions approximating 11 inches in length, 8 inches in width, and 1 inch in thicknes, and said bean bag has dimensions approximating 4 inches in length, 3 inches in width, and 1.5 inches in thickness.

* * * * *